US009975746B2

(12) United States Patent
Buckingham et al.

(10) Patent No.: US 9,975,746 B2
(45) Date of Patent: May 22, 2018

(54) APPARATUS AND METHOD FOR CONTROLLING JACKS

(71) Applicants: Mark Allen Buckingham, Bernville, PA (US); Jamin Ray Buckingham, Bernville, PA (US)

(72) Inventors: Mark Allen Buckingham, Bernville, PA (US); Jamin Ray Buckingham, Bernville, PA (US)

( * ) Notice: Subject to any disclaimer, the term of this patent is extended or adjusted under 35 U.S.C. 154(b) by 298 days.

(21) Appl. No.: 14/658,882

(22) Filed: Mar. 16, 2015

(65) Prior Publication Data

US 2016/0272470 A1 Sep. 22, 2016

(51) Int. Cl.
*A62B 3/00* (2006.01)
*B66F 3/24* (2006.01)
*B66F 3/46* (2006.01)

(52) U.S. Cl.
CPC . *B66F 3/24* (2013.01); *B66F 3/46* (2013.01)

(58) Field of Classification Search
USPC ..... 254/10 R, 89 H, 93 R, 423
See application file for complete search history.

(56) References Cited

U.S. PATENT DOCUMENTS 5,199,686 A * 4/1993 Fletcher ..... B66F 7/08 187/211
2007/0210292 A1* 9/2007 Zou ..... B60S 9/12 254/423
2010/0207079 A1* 8/2010 Kooima ..... B66F 3/46 254/1

* cited by examiner

*Primary Examiner* — Joseph J Hail
*Assistant Examiner* — Shantese McDonald
(74) *Attorney, Agent, or Firm* — Maier & Maier, PLLC

(57) ABSTRACT

According to at least one exemplary embodiment, a scalable jacking machine system may be provided. The system may include at least one jacking machine, which may include at least one controller, at least one monitoring device, and at least one electronically controlled valve. The at least one controller may be configured to communicate over a wired or wireless network with a controller of at least one other jacking machine, allowing the jacking machines to operate in unison.

20 Claims, 2 Drawing Sheets

APPARATUS AND METHOD FOR CONTROLLING JACKS

BACKGROUND

Jacks and jacking machines come in a variety of configurations and are generally used to lift heavy objects. Some jacks may even be used to lift large structures, such as buildings or houses. A plurality of jacks may be used simultaneously to lift an object. It may be desired for the plurality of jacks to raise or lower at a unified rate, regardless of differences in the load borne by each jack. These jacking machines may come in a variety of sizes, each capable of actuating a set number of jacks. For example, these jacking machines may range to upwards of 120 jacking ports. Consequently, a jacking machine must be matched appropriately for the object being lifted. While it is not required to use the full capacity of jacks for a jacking machine, transporting and using a high capacity jacking machine may not be efficient or feasible. There are many logistical considerations when using large capacity jacking machines, including the size and weight of the machines themselves. It can be very difficult to move the machines and they may not be practical in all work environments. Additionally, special permits may be required to use or transport the machines. Therefore, it may be preferable to use one or more smaller jacking machines. However, each unified jacking machine must be controlled independently, which may be disadvantageous compared to one larger unified jacking machine capable of handling the requisite number of jacks for a load.

SUMMARY

According to at least one exemplary embodiment, a scalable jacking machine apparatus may be provided. A scalable jacking machine apparatus may include a primary jacking machine, having at least one controller, at least one monitoring device, and an electronically controlled main valve. At least one secondary jacking machine, having at least one controller, at least one monitoring device, and an electronically controlled main valve may also be included. The scalable jacking machine apparatus may further include a network. The at least one controller of the primary jacking machine may be configured to communicate data from the at least one monitoring device of the primary jacking machine to the at least one controller of the at least one secondary jacking machine over the at least one network. The at least one controller of the at least one secondary jacking machine may be configured to actuate the electronically controlled main valve of the at least one secondary jacking machine to cause data from the at least one monitoring device of the secondary jacking machine to match the data from the at least one monitoring device of the primary jacking machine.

According to another exemplary embodiment, a method for controlling a plurality of unified jacking machines may be provided. The method may include providing a primary jacking machine. The primary jacking machine may include at least one controller, at least one monitoring device, and an electronically controlled main valve. At least one secondary jacking machine may also be provided. The at least one secondary jacking machine may include at least one controller, at least one monitoring device, and an electronically controlled main valve. At least one network may additionally be provided. The at least one controller of the primary jacking machine may be configured to communicate data from the at least one monitoring device of the primary jacking machine to the at least one controller of the at least one secondary jacking machine over the at least one network. The at least one controller of the at least one secondary jacking machine may also be configured to actuate the electronic controls of the at least one secondary jacking machine to cause data from the at least one monitoring device of the secondary jacking machine to match the data from the at least one monitoring device of the primary jacking machine. The next step in the method may be instructing the primary jacking machine to adjust a primary main ram by adjusting a primary jacking machine main ram control. The at least one monitoring device and at least one controller of the at least one secondary jacking machine may be allowed to match the adjustment to the primary main ram.

According to a further exemplary embodiment, a non-transitory computer-readable medium for controlling a scalable jacking machine apparatus may be provided. The non-transitory computer-readable medium may include instructions stored thereon, that when executed on a processor, perform the following steps: obtaining a scale reading of a main ram, obtaining primary main ram data, comparing the scale reading of the main ram to the primary main ram data, actuating an electronically controlled jacking machine unified control valve to bring the main ram scale reading in sync with the primary main ram data, and continuously monitoring for differences in the readings to be corrected.

According to yet another exemplary embodiment, a scalable jacking machine apparatus may be provided. The scalable jacking machine apparatus may include a control device, which may be configured to allow a user to input primary main ram data. It may further include at least one jacking machine, which may have at least one microcontroller, at least one monitoring device, and an electronically controlled main valve. The scalable jacking machine apparatus may also include at least one network. The control device may be configured to communicate target main ram data to the at least one microcontroller of the at least one jacking machine over the at least one network. The at least one microcontroller of the at least one jacking machine may be configured to actuate the electronically controlled main valve of the at least one jacking machine to cause data from the at least one monitoring device of the jacking machine to match the target main ram data from the control device.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which.

Exemplary

Exemplary

DETAILED DESCRIPTION OF THE EMBODIMENTS

Figure 1:
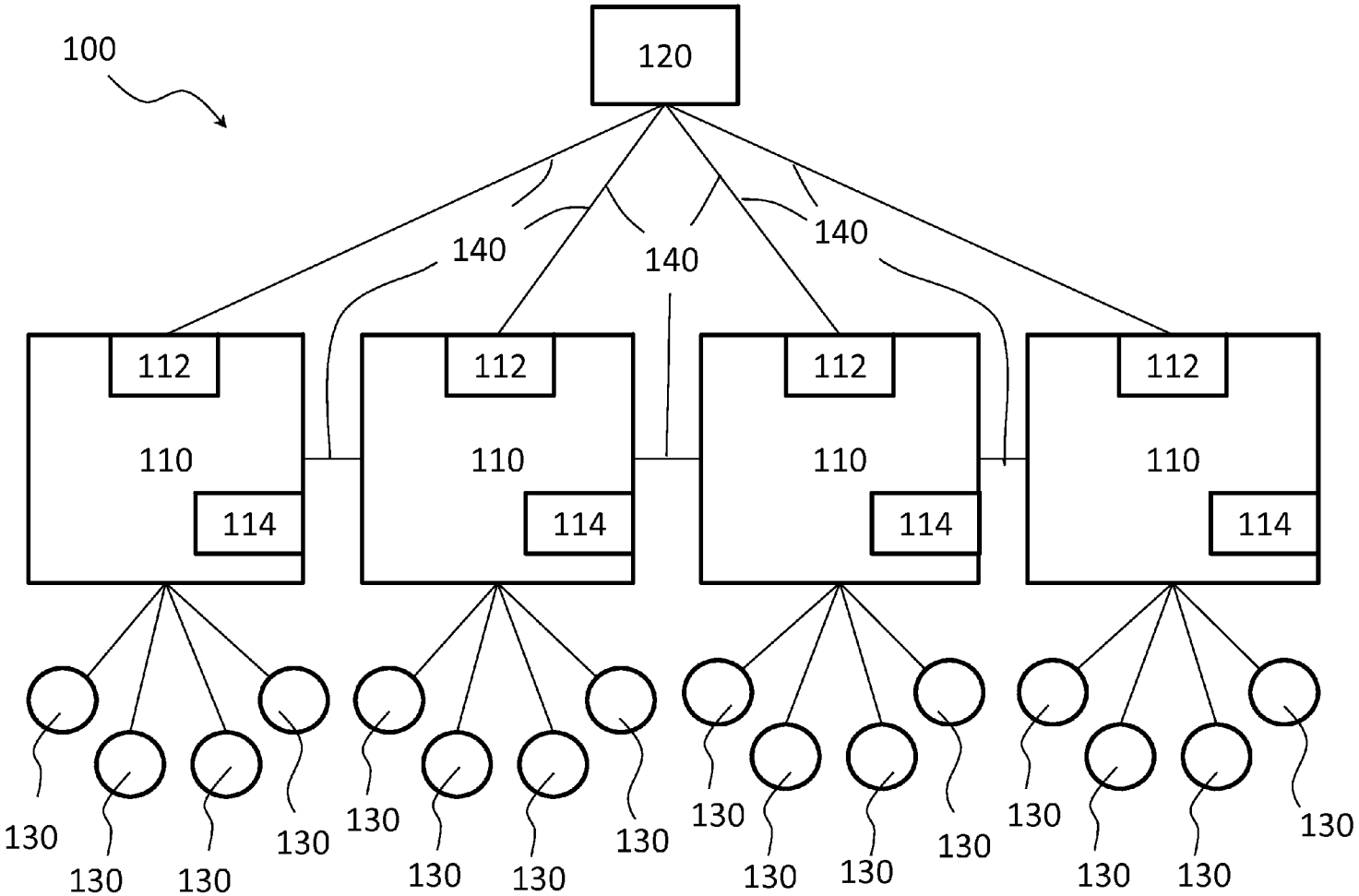
FIG. 1 shows a diagram of a scalable jacking machine and control system.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

Further, many of the embodiments described herein are described in terms of sequences of actions to be performed by, for example, elements of a computing device. It should be recognized by those skilled in the art that the various sequences of actions described herein can be performed by specific circuits (e.g. application specific integrated circuits (ASICs)) and/or by program instructions executed by at least one processor. Additionally, the sequence of actions described herein can be embodied entirely within any form of computer-readable storage medium such that execution of the sequence of actions enables the at least one processor to perform the functionality described herein. Furthermore, the sequence of actions described herein can be embodied in a combination of hardware and software. Thus, the various aspects of the present invention may be embodied in a number of different forms, all of which have been contemplated to be within the scope of the claimed subject matter. In addition, for each of the embodiments described herein, the corresponding form of any such embodiment may be described herein as, for example, "a computer configured to" perform the described action.

According to an exemplary embodiment, and referring to the Figures generally, a scalable jacking machine and control system 100 may be provided. A scalable jacking machine and control system may include at least one jacking machine 110, which may be configured to operate in combination with other jacking machines 110. In an exemplary embodiment, each jacking machine 110 may control at least one jack 130 and in some embodiments may be a unified jacking machine. In embodiments incorporating more than one jacking machine 110, the control system may synchronize the jacking machines 110 to work in unison. The scalable jacking machine and control system 100 may computerize the controls and monitoring components of a jacking machine, allowing communication and synchronization with multiple jacking machines 110 tied together via a wired or wireless network 140. Each jacking machine 110 may include at least one controller 112, which may be a microcontroller, and at least one monitoring device 114. Microcontroller 112 may include a processor, resource memory, and at least one program module with instructions to perform as described herein. In some embodiments, the system 100 may further include a control device 120 which may be communicatively coupled to the at least one microcontroller 112 via network 140 and may provide a user interface for controlling the at least one jacking machine 110. Alternatively, a user interface for control of a jacking machine may be implemented in the machine, itself. In some exemplary embodiments, when jacking machines are tied together and used synchronously, a user interface on a primary machine may control all of the networked machines.

In an exemplary embodiment, a jacking machine may include a power source, a hydraulic fluid reservoir, at least one hydraulic ram, and at least one port having at least one valve for controlling the flow of hydraulic fluid to and from at least one hydraulic jack connected by a hose. An exemplary jacking machine may include a set number of ports. The at least one jack may be any type of jack as would be understood by a person having ordinary skill in the art, including but not limited to a crib jack. Exemplary jacks may be of any weight rating. Non-limiting examples may include 15 ton, 30 ton, 60 ton, 100 ton, or 200 ton jacks. A jacking machine may be configured to operate with jacks of any size. However, for unified operation, it may be preferred that the jacks have equal fluid displacement. A jack's fluid displacement may affect the rate at which the jack rises or lowers. For example, a 30 ton jack may move at half the speed of a 15 ton jack. A unified jacking machine may still function properly with jacks of varying sizes. For example, an embodiment having at least one 15 ton jack and at least one 30 ton jack may operate in a unified fashion so long as each 30 ton size jack is tied into twice as many fluid ports as each 15 ton size jack. Therefore, the flow of hydraulic fluid to the 30 ton jack will be exactly twice as much as the 15 ton jack. This principal may be applied for any size jacks, as would be understood by a person having ordinary skill in the art.

In operation, a unified jacking machine may pressurize all jacks equally in a common pressure mode until the jack with the lightest weight has been loaded to desired percentage of total weight. At this point, this jack, including its supports and hydraulic hoses, may have been pre-stressed for lifting the load. Once the first jack has been pre-stressed, its common pressure hydraulic valve may be closed in order to isolate the jack circuit for unified mode. The process may then be repeated for each subsequent jack. Each individual slave cylinder and the main ram may be pre-stressed. Once every jack has been properly pressurized and isolated, a main hydraulic selector valve may be switched from common pressure mode to unified mode. Each port being used on the at least one jacking machine should also have been switched to unified mode, as previously described. This may enable the main unified ram valve to extend or retract all of the jacks in unison. There may be slave cylinders for each port in a main hydraulic tank. Once locked off in unified mode, the individual slave cylinders may have been pre-pressurized to the at least one jack connected to the associated port. As the unified valve is adjusted to actuate the jacks, the main hydraulic ram may travel within the fluid reservoir, compressing the slave cylinders and forcing the hydraulic fluid to each jack at an equal rate, regardless of the pressure in each jack. Therefore, each jack may be at a different pressure, but the whole unit may be lifted uniformly. As the main ram moves, the distance each jack ram extends may be calculated by the movement of the main ram. This may be advantageous by only requiring a monitoring device in the jacking machine, rather than each individual jack.

In an exemplary jacking machine, each port may include a series of valves for controlling the hydraulic circuit created through the port. Each port may include an on/off valve, which may allow the flow of oil through the port when in an "on" position. There may also be a valve for allowing pressure to be returned to the main tank. There may additionally be a valve for controlling whether the port is in common pressure mode or in unified mode. This valve may be placed in common pressure mode when pre-pressurizing the jacks. The jacking machine may also include a main valve which may be placed in a common pressurize orientation to facilitate pressurizing each jack. Once each jack has been pre-pressurized to a desired pressure, the common pressure/unified valve may be switched to unified mode. This may lock off the port so that the current pressure is maintained. When all desired jacks have been locked off in unified mode and the main valve has been switched to unified mode, the system may actuate the jacks in a unified manner. The valves may be any type of valve as would be understood by a person having ordinary skill in the art, including ball valves, needle valves, butterfly valves, globe valves, gate valves, diaphragm valves, pinch valves, stopcocks, flaps, inlets, taps, or faucets. In an exemplary embodiment, the main valve may be electronically controlled and some or all of the remaining valves may optionally be electronically controlled.

A jacking machine may include a main valve for pressurizing the individual slave cylinders and jacks when in pressurize mode and for controlling the main ram when in unified mode. The same main valve may in turn pressurize the individual jacks or raise the jacks in unified mode. In an exemplary embodiment, the main valve may be electronically controlled. In some embodiments, there may be an electronic control interface on a jacking machine for controlling the main valve. By implementing electronically actuated valves and an electronic control for the main valve, a microcontroller may be configured to control operation of at least one jacking machine based on measurements from devices monitoring various components of the at least one jacking machine, such as the main ram, and based on user inputs. In some further exemplary embodiments, there may be monitoring devices on individual jacks, which may communicate data to the jacking machine microcontroller. Monitoring devices on the individual jacks may include string pots.

An exemplary embodiment of a scalable jacking machine may include electronically operated valve controls for the main ram valve and optionally all remaining valves. Additionally, an exemplary embodiment may include an electronic monitoring device for measuring the stroke of the main ram. This may be an encoder, such as a linear scale encoder. Each scalable jacking machine may have a controller or microcontroller configured to process main ram position information communicated by the electronic monitoring device, actuate electronic valves, process user input, and communicate over a wired or wireless network with at least one other scalable jacking machine or control device. The precision or tolerance of the system may be equivalent to the scale of the electronic monitoring device. In an exemplary embodiment, the tolerance may be less than approximately $\frac{1}{8}^{th}$ of an inch. A scalable jacking machine may further optionally include a visual display to provide system feedback, such as ram stroke data, to an operator. The optional visual display may be provided on each unit or may be a remote display. In some exemplary embodiments, the display may provide a graphical user interface, through which a user may input instructions for the jacking system.

The travel of each jack may be determined by the stroke of the main ram, when operating in unified mode. Therefore, to ensure that multiple jacking machines, and consequently the at least one jack associated with each multiple jacking machine, are working in unison, the main ram stroke data may be compared among the jacking machines. The jacking machines may be connected by a wired or wireless network. One jacking machine may be designated as a primary jacking machine. All other jacking machines may be secondary and may operate as slaves off of the primary machine. Therefore, the ram stroke of each secondary machine may be adjusted by the microcontroller to match the ram stroke linear scale reading of the primary machine. In an exemplary embodiment, a program module on microcontroller 112 may include instructions for receiving primary main ram data and controlling a secondary main ram to match the received, or target, main ram data. Primary main ram data may include data from a primary jacking machine main ram. In some alternative embodiments, there may not be a primary jacking machine. Instead, primary main ram data may be target main ram data inputted by a user through a control device 120. All jacking machines may treat the inputted target main ram data as primary main ram data and may consequently act as slaves to the inputted data. All jacking machines may remain in tolerance of each other based on the scale reading.

Figure 2:
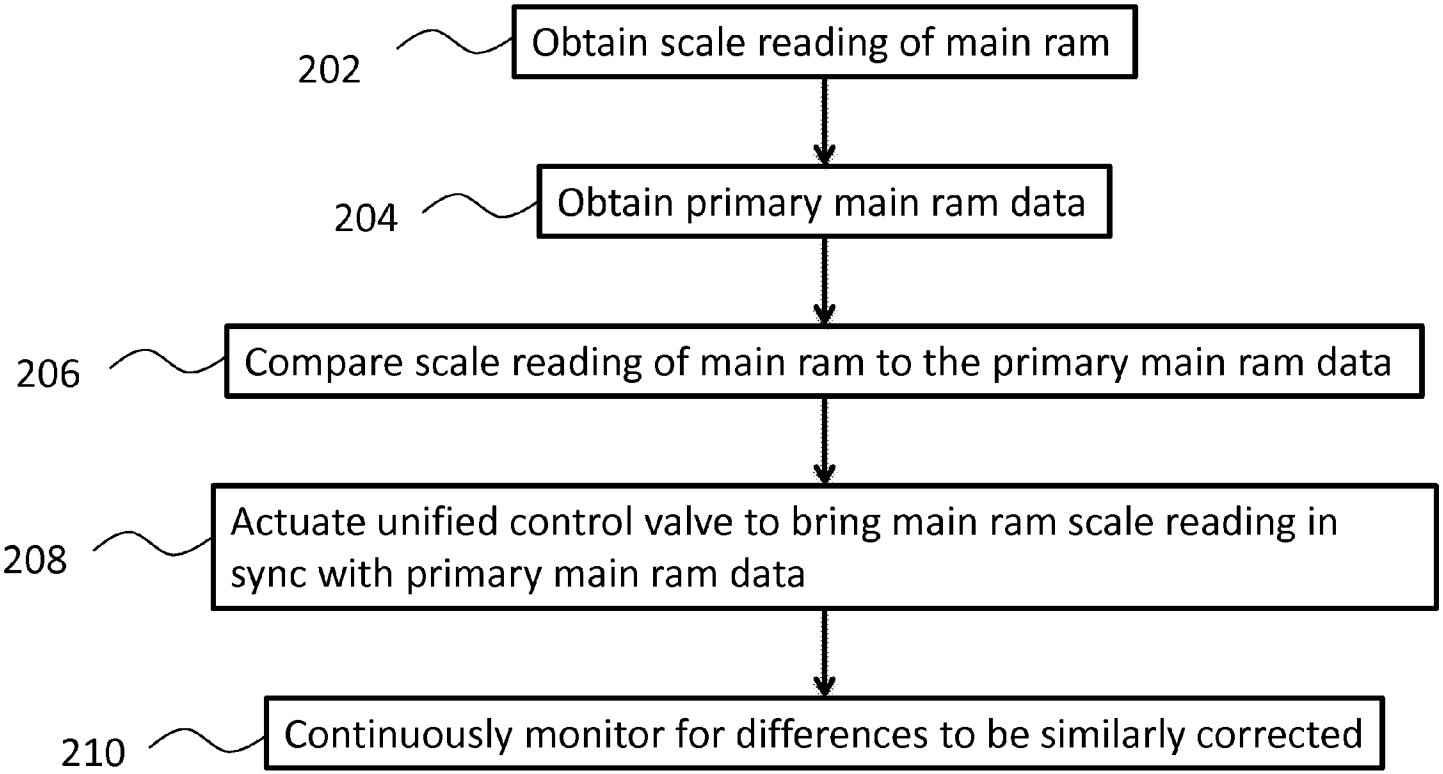
FIG. 2 shows a flow chart of the operation of a scalable jacking machine and control system.

Now referring to exemplary FIG. 2, the at least one microcontroller may be configured to employ a comparator algorithm, which may obtain a scale reading of a secondary jacking machine's main ram 202, obtain a scale reading of a primary 204, compare the scale reading of the secondary main ram to the primary 206, and subsequently actuate the unified valve until the scale reading of the main ram matches the primary 208. The system may continuously monitor for differences between the readings, which in turn may be similarly corrected 210. To begin, every jacking machine may be zeroed to a given set point. As a user initiates movement of the primary, each secondary machine may be adjusted to match. If a machine falls outside a preset tolerance from the primary main ram data, the controller of that machine may actuate the electronic valves to compensate for the error and bring the machine in sync with the primary. If a machine falls outside of an acceptable error band, the system may shut down and may alert a user, in order to prevent harm to the load.

In some exemplary embodiments, a scalable jacking machine system may additionally include a remote display and control device. Each jacking machine's microcontroller may be configured to communicate with the remote device via the wired or wireless network. The remote device may provide a graphical user interface, which may show all jacking machine positions to a user and may provide for the input of user instruction, including adjusting the primary, which the secondary machines would copy in turn, based on data communicated from a primary jacking machine's monitoring device or a control device 120.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A scalable jacking machine apparatus comprising:

a primary jacking machine, having at least one controller, at least one monitoring device, and an electronically controlled main valve;

at least one secondary jacking machine, having at least one controller, at least one monitoring device, and an electronically controlled main valve; and at least one network, wherein the at least one controller of the primary jacking machine is configured to communicate data from the at least one monitoring device of the primary jacking machine to the at least one controller of the at least one secondary jacking machine over the at least one network; and wherein the at least one controller of the at least one secondary jacking machine is configured to actuate the electronically controlled main valve of the at least one secondary jacking machine to cause data from the at least one monitoring device of the secondary jacking machine to match the data from the at least one monitoring device of the primary jacking machine, wherein the primary jacking machine and at least one secondary jacking machine each control at least two jacks configured to operate in unison at different pressures, wherein the at least two jacks are driven in unison by a main ram of the primary jacking machine or at least one secondary jacking machine.

2. The apparatus of claim 1, wherein the primary jacking machine and at least one secondary jacking machine are unified hydraulic jacking machines.

3. The apparatus of claim 1, further comprising a display and control device configured to communicate with the at least one controller of the primary jacking machine and at least one secondary jacking machine.

4. The apparatus of claim 1, wherein the at least one network is wired.

5. The apparatus of claim 1, wherein the at least one network is wireless.

6. The apparatus of claim 1, wherein at least one valve is electronically controlled.

7. A method for controlling a plurality of unified jacking machines comprising:

providing a primary jacking machine, the primary jacking machine comprising at least one controller, at least one monitoring device, and an electronically controlled main valve;

providing at least one secondary jacking machine, the at least one secondary jacking machine comprising at least one controller, at least one monitoring device, and an electronically controlled main valve;

providing at least one network, wherein the at least one controller of the primary jacking machine is configured to communicate data from the at least one monitoring device of the primary jacking machine to the at least one controller of the at least one secondary jacking machine over the at least one network, and wherein the at least one controller of the at least one secondary jacking machine is configured to actuate the electronic controls of the at least one secondary jacking machine to cause data from the at least one monitoring device of the secondary jacking machine to match the data from the at least one monitoring device of the primary jacking machine;

instructing the primary jacking machine to adjust a primary main ram by adjusting a primary jacking machine main ram control; and allowing the at least one monitoring device and at least one controller of the at least one secondary jacking machine to match the adjustment to the primary main ram, wherein the primary jacking machine and at least one secondary jacking machine each control at least two jacks configured to operate in unison at different pressures, wherein the at least two jacks are driven in unison by the primary main ram of the primary jacking machine or a main ram of the at least one secondary jacking machine.

8. The method of claim 7, wherein the primary jacking machine and at least one secondary jacking machine are unified hydraulic jacking machines.

9. The method of claim 7, further comprising providing a display and control device configured to communicate with the at least one controller of the primary jacking machine and at least one secondary jacking machine.

10. The method of claim 7, wherein the at least one network is wired.

11. The method of claim 7, wherein the at least one network is wireless.

12. The method of claim 7, wherein at least one valve is electronically controlled.

13. A non-transitory computer-readable medium for controlling a scalable jacking machine apparatus, comprising instructions stored thereon, that when executed on a processor, perform the steps of:

obtaining a scale reading of a main ram of at least one secondary jacking machine;

obtaining primary main ram data of a primary jacking machine;

comparing the scale reading of the main ram to the primary main ram data;

actuating an electronically controlled jacking machine unified control valve to bring the main ram scale reading in sync with the primary main ram data; and continuously monitoring for differences in the readings to be corrected, wherein the primary jacking machine and at least one secondary jacking machine each control at least two jacks configured to operate in unison at different pressures, wherein the at least two jacks are driven in unison by the primary main ram of the primary jacking machine or the main ram of the at least one secondary jacking machine.

14. The non-transitory computer-readable medium of claim 13, wherein the primary main ram data is inputted through a control device.

15. The non-transitory computer-readable medium of claim 13, wherein the primary main ram data is a scale reading from a main ram monitoring device on a primary jacking machine.

16. A scalable jacking machine apparatus comprising:

a control device, configured to allow a user to input primary main ram data;

at least one jacking machine, having at least one microcontroller, at least one monitoring device, and an electronically controlled main valve; and at least one network, wherein the control device is configured to communicate target main ram data to the at least one microcontroller of the at least one jacking machine over the at least one network; and wherein the at least one microcontroller of the at least one jacking machine is configured to actuate the electronically controlled main valve of the at least one jacking machine to cause data from the at least one monitoring device of the jacking machine to match the target main ram data from the control device, wherein the at least one jacking machine controls at least two jacks configured to operate in unison at different pressures, and wherein the at least two jacks are driven in unison by the main ram.

17. The apparatus of claim 16, wherein the at least one jacking machine is a unified hydraulic jacking machines.

18. The apparatus of claim 16, wherein the at least one network is wired.

19. The apparatus of claim 16, wherein the at least one network is wireless.

20. The apparatus of claim 16, wherein at least one valve is electronically controlled.

* * * * *